US007974550B2

(12) United States Patent
Suzuki et al.

(10) Patent No.: US 7,974,550 B2
(45) Date of Patent: Jul. 5, 2011

(54) IMAGE FORMING APPARATUS, IMAGE FORMING STRUCTURAL BODY, METHOD OF MOUNTING IMAGE FORMING STRUCTURAL BODY AND METHOD OF PULLING OUT IMAGE FORMING STRUCTURAL BODY

(75) Inventors: Wataru Suzuki, Ebina (JP); Atsuyuki Kitamura, Ebina (JP); Masahiro Sato, Ebina (JP); Shinichiro Fujimori, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 435 days.

(21) Appl. No.: 12/158,619

(22) PCT Filed: Dec. 20, 2006

(86) PCT No.: PCT/JP2006/325326

§ 371 (c)(1),
(2), (4) Date: Jun. 20, 2008

(87) PCT Pub. No.: WO2007/072839

PCT Pub. Date: Jun. 28, 2007

(65) Prior Publication Data

US 2009/0162087 A1 Jun. 25, 2009

(30) Foreign Application Priority Data

Dec. 20, 2005 (JP) ..... 2005-366440
Oct. 31, 2006 (JP) ..... 2006-296104

(51) Int. Cl.

| | |
|---|---|
| ***G03G 15/00*** | (2006.01) |
| ***G03G 21/16*** | (2006.01) |
| ***G03G 21/18*** | (2006.01) |
| ***G03G 15/02*** | (2006.01) |

(52) U.S. Cl. ..... 399/107; 399/108; 399/109; 399/110; 399/111; 399/112; 399/113; 399/116; 399/117

(58) Field of Classification Search ..... 399/107–113, 399/116, 117

See application file for complete search history.

(56) References Cited

U.S. PATENT DOCUMENTS 5,111,244 A * 5/1992 Koyama et al. ..... 399/111
2005/0196194 A1 * 9/2005 Suda et al. ..... 399/111

FOREIGN PATENT DOCUMENTS

JP A-9-95013 4/1997

(Continued)

OTHER PUBLICATIONS

Mar. 2, 2010 Office Action issued in Japanese Patent Application No. 2006-296104 (with translation).

*Primary Examiner* — David P Porta
*Assistant Examiner* — Mindy Vu
(74) *Attorney, Agent, or Firm* — Oliff & Berridge, PLC

(57) ABSTRACT

The present invention provides an image forming apparatus including: a conveyer that conveys a developer image or a transfer medium to which the developer image is transferred; an image carrier that carries the developer image transferred to the conveyer or the transfer medium which the conveyer conveys; a latent image forming unit that forms the latent image on the image carrier; a developing unit that develops the latent image formed on the image carrier and forms the a developer image; a transfer unit that transfers the developer image formed on the image carrier; and a restricting unit that restricts the movement of the image carrier and the latent image forming unit in at least two directions and a rotational direction of the image carrier.

21 Claims, 9 Drawing Sheets

FOREIGN PATENT DOCUMENTS

| | | |
|---|---|---|
| JP | A-2001-066968 | 3/2001 |
| JP | A-2001-142274 | 5/2001 |
| JP | A-2003-168132 | 6/2003 |
| JP | A-2003-195724 | 7/2003 |

* cited by examiner

IMAGE FORMING APPARATUS, IMAGE FORMING STRUCTURAL BODY, METHOD OF MOUNTING IMAGE FORMING STRUCTURAL BODY AND METHOD OF PULLING OUT IMAGE FORMING STRUCTURAL BODY

RELEVANT TECHNICAL FIELD

The present invention restates to an image forming apparatus, an image forming structural body, a method of mounting an image forming structural body, and a method of pulling out an image forming structural body.

PRIOR ART

Means for Solving Problem

The present invention is directed to an image forming apparatus comprising: a conveyer that conveys a developer image or a transfer medium to which the developer image is transferred; an image carrier that carries the developer image transferred to the conveyer or the transfer medium which the conveyer conveys; a latent image forming unit that forms the latent image on the image carrier; a developing unit that develops the latent image formed on the image carrier and forms a developer image; a transfer unit that transfers the developer image formed on the image carrier; and a restricting unit that restricts the movement of the image carrier and the latent image forming unit in at least two directions and a rotational direction of the image carrier.

EXPLANATIONS OF LETTERS AND NUMERALS

Figure 1:
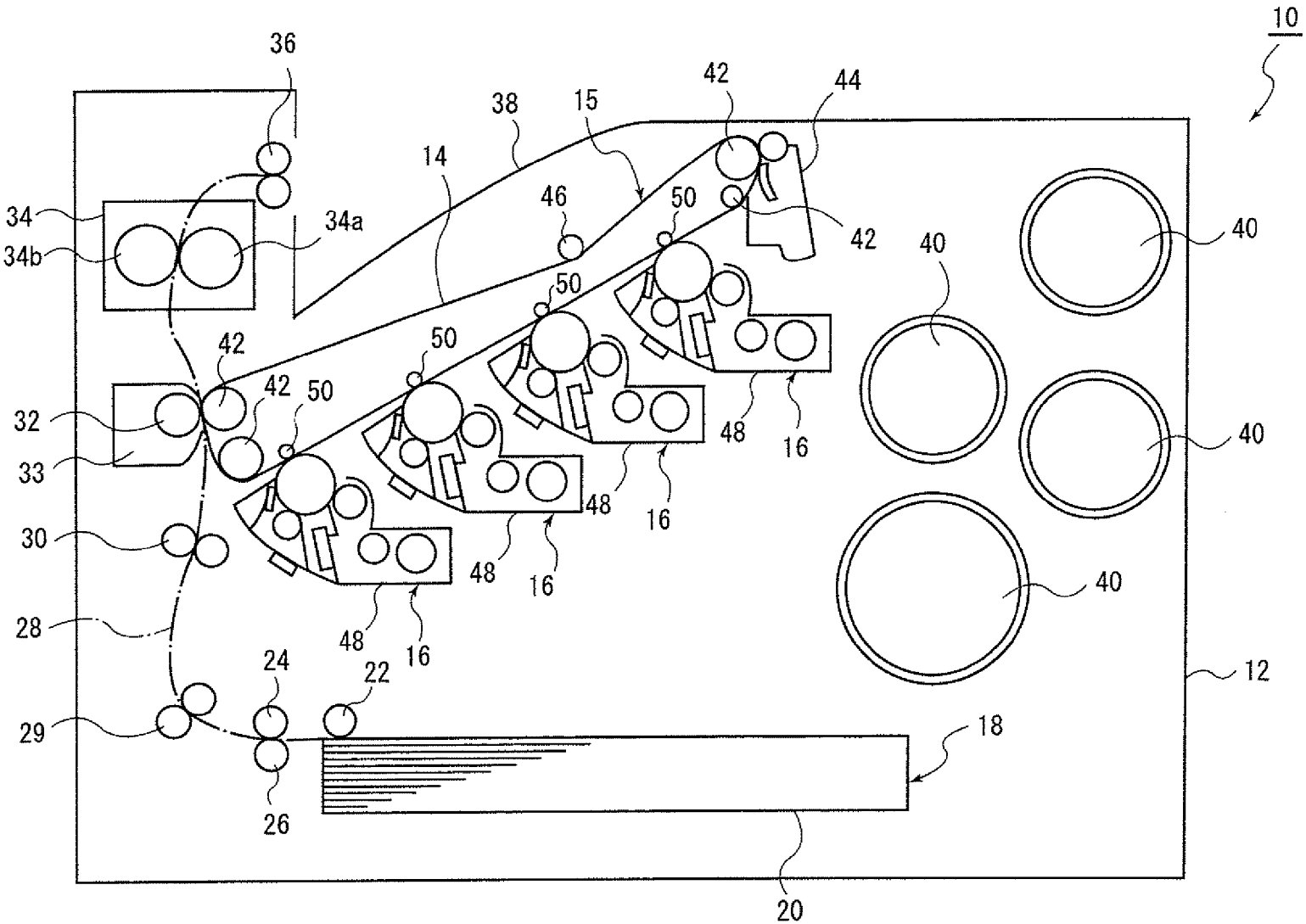
FIG. 1 A front view showing the schematic constitution of an image forming apparatus of a first embodiment of the present invention.

10: Image forming apparatus
12: Image forming apparatus body
14: Intermediate transfer belt
15: Transfer structural body
48: Image forming structural body
50: Transfer member
52: Photoreceptor
53: Bearing
56: Latent image forming member
86: Transfer structural body housing
88: Side plate
90: Side plate
118: Projecting portion
130: Projecting portion
140: Positioning mechanism
142: Projecting portion

MODE FOR CARRYING OUT THE INVENTION

Next, embodiments of the present invention are explained in conjunction with the drawings.

FIG. 1 shows an image forming apparatus 10 according to an embodiment of the present invention. The image forming apparatus 10 includes an image forming apparatus body 12. In the image forming apparatus body 12, a transfer structural body 15 which includes an intermediate transfer belt 14 constituting a conveying member is arranged. Further, an image forming means-sections 16 which form images to be transferred to the intermediate transfer belt 14 are mounted in the image forming apparatus body 12 in a state that four image forming sections 16 are arranged in parallel to each other, for example. That is, the image forming apparatus 10 adopts a so-called tandem system. The four image forming sections 16 respectively form toner images of respective colors consisting of yellow, magenta, cyan and black.

A sheet feeding device 18 is provided in a lower portion of the image forming apparatus body 12. The sheet feeding device 18 includes a sheet stacking device 20 in which sheets used as transfer mediums are stacked, a pick-up roller 22 which picks up the sheets stacked in the sheet stacking device 20, a feed roller 24 and a retardation roller 26 which feed the sheets while sorting. The sheet stacking device 20 is detachably arranged with respect to the image forming apparatus body 12 such that the sheet stacking device 20 can be pulled out in the sheet-front-surface-side direction in the drawing. Sheets such as ordinary sheets or OHP sheets, for example, are stored in the sheet stacking device 20 in a stacked state.

A sheet supply passage 28 is provided approximately along the vertical direction in the vicinity of one end (in the vicinity of the left side in the drawing) of the image forming apparatus body 12. To the sheet supply passage 28, a transport roller 29, a registration roller 30, a second transfer roller 32, a fixing device 34 and an exit roller 36 are provided. The registration roller 30 temporarily stops a sheet fed out to the sheet supply passage 28 and feeds the sheet to the second transfer roller 32 at proper timing. The fixing device 34 is constituted of a heating roller 34*a* and a pushing roller 34*b*, wherein heat and pressure are applied to a sheet passing between the heating roller 34*a* and the pushing roller 34*b* thus fixing a toner image on the sheet. The second transfer roller 32 is made detachable with respect to the image forming apparatus body 12 as a second transfer structural body 33 and can be pulled out in the sheet-front-surface-side direction in FIG. 1.

An exit portion 38 is arranged in an upper portion of the image forming apparatus body 12. A sheet on which a developer image is fixed is conveyed to the exit portion 38 by the above-mentioned exit roller 36 and is stacked in the exit portion 38. Accordingly, the sheets in the sheet stacking device 20 are sequentially conveyed to the exit portion 38 through a C-shaped path.

Four toner bottles 40 are provided to another end side (to the right side in the drawing) of the image forming apparatus body 12, for example. The toner bottles 40 store toners of yellow, magenta, cyan and black therein respectively, and supply the toners to the image forming section 16 by way of toner supply passages not shown in the drawing.

Each of the plural image forming sections 16 forms an image forming structural body 48 as one unit structure, while the respective image forming sections 16 are mounted in the image forming apparatus body 12 in an independently detachable manner. The image forming structural body 48 is pulled out of the image forming apparatus body 12 in such a way that the image forming structural body 48 is once moved downwardly and, thereafter, is pulled out in the sheet-front-surface-side direction in FIG. 1, for example.

The transfer structural body 15 includes the intermediate transfer belt 14 as mentioned above. The transfer structural body 15 also includes a plurality of support rollers 42 which supports the intermediate transfer belt 14, plural transfer members 50 which is constituted of first transfer rollers, for example, for transferring toner images formed by the plural image forming sections 16 respectively to the intermediate transfer belt 14, and an intermediate belt cleaning device 44 for cleaning the intermediate transfer belt 14. The transfer structural body 15 is made detachable with respect to the image forming apparatus body 12 and can be pulled out in the sheet-front-surface-side direction in FIG. 1.

The intermediate transfer belt 14 is supported by the plural support rollers 42 and a belt surface of the intermediate transfer belt 14 on a side on which the image forming sections 16 are arranged is arranged obliquely with respect to the horizontal direction. One of the support rollers 42 constitutes a back-up roller for the second transfer roller 32. Further, in the vicinity of the upper end of the intermediate transfer belt 14, the intermediate transfer belt cleaning device 44 is arranged and another one of the support rollers 42 is used as a back-up roller for the cleaning device 44. Still further, above the intermediate transfer belt 14, a tension roller 46 is arranged and the tension roller 46 applies proper tension to the intermediate transfer belt 14.

Figure 2:
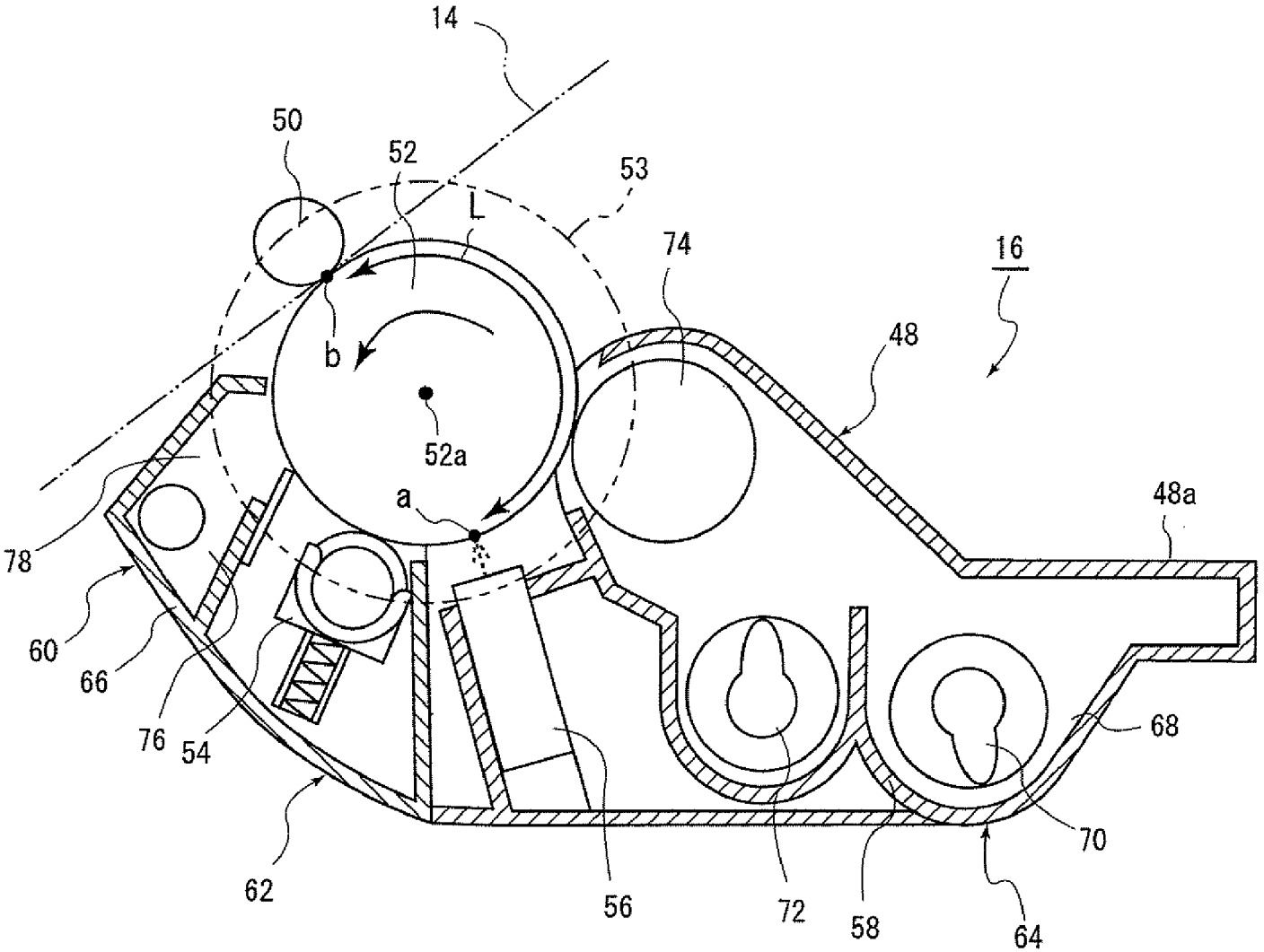
FIG. 2 A front view showing the constitution of an image forming structural body of the first embodiment of the present invention.
Figure 3:
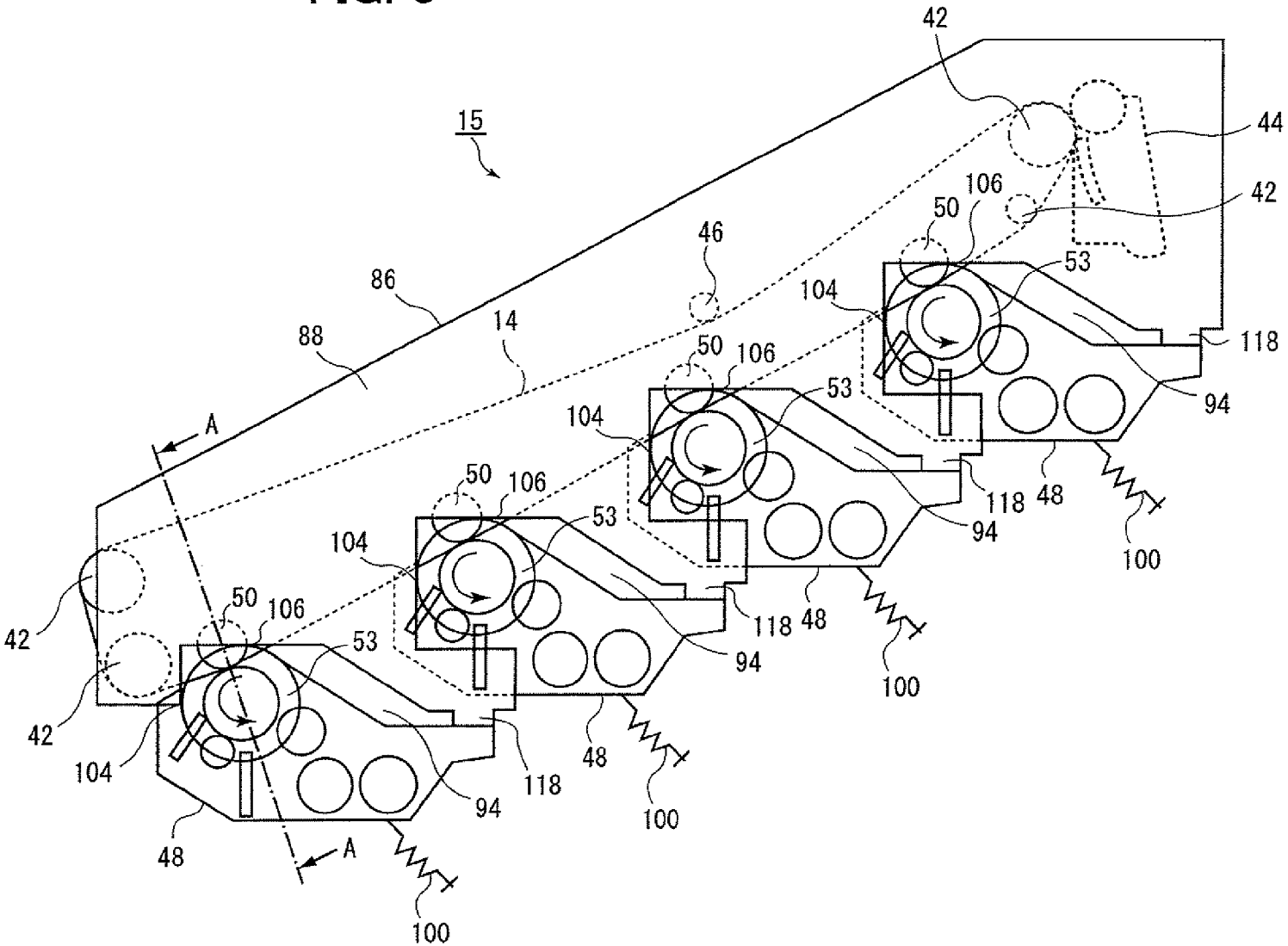
FIG. 3 A front view showing the constitution of a transfer structural body used in the first embodiment of the present invention and a state in which the image forming structural body is positioned in the transfer structural body.
Figure 4:
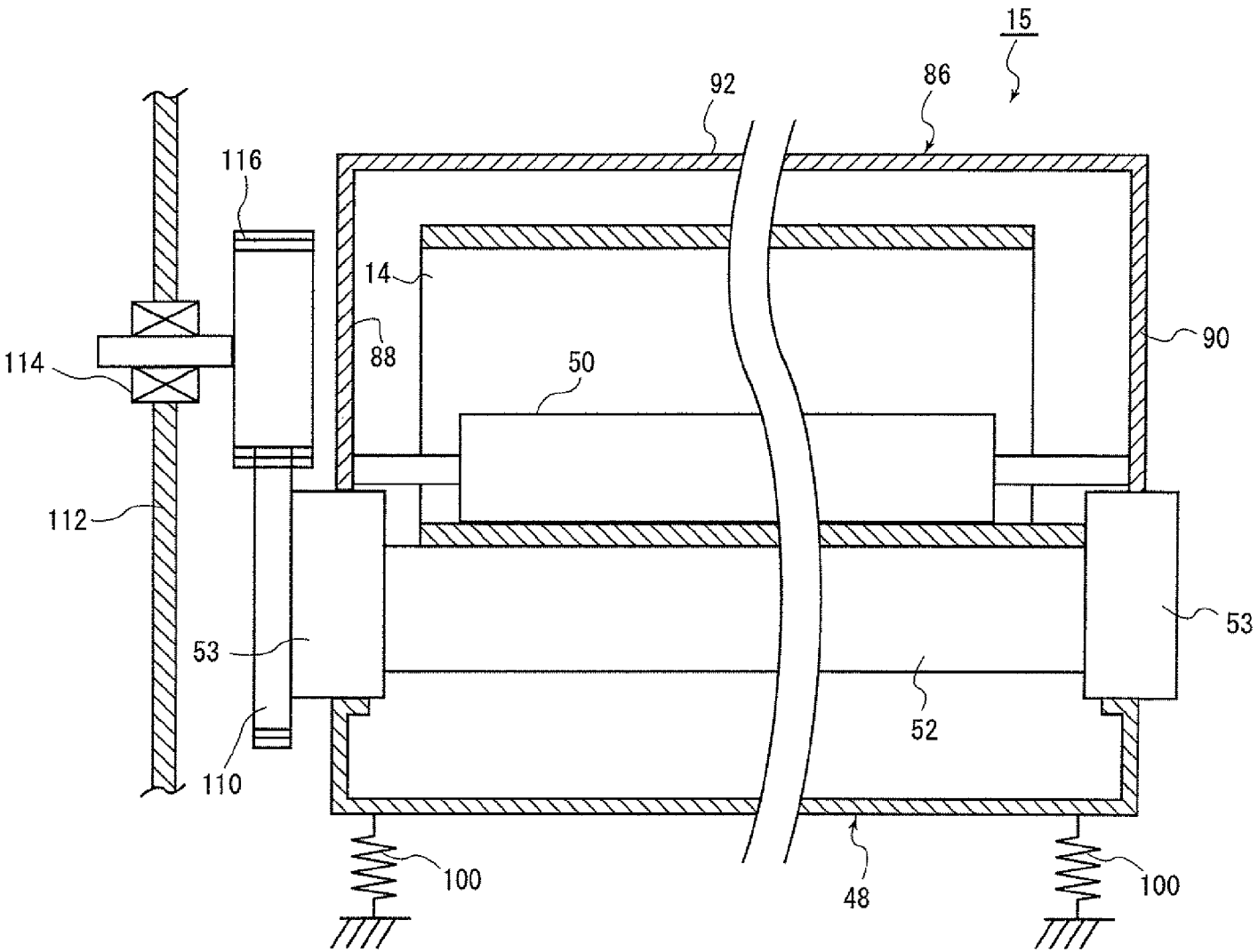
FIG. 4 A cross-sectional view showing a cross section of the transfer structural body used in an embodiment of the present invention and is a cross-sectional view of the transfer structural body taken along a line A-A in FIG. 3.

FIG. 2 to FIG. 4 show the image forming section 16 and the transfer structural body 15.

The image forming section 16 is integrally formed as the image forming structural body 48 as previously mentioned. A photoreceptor 52 which is used as an image carrier, a charging device 54 for charging the photoreceptor 52 and is constituted of a roller, for example, a latent image forming member 56 and forms a latent image by optical writing in the photoreceptor 52, a developing device 58 for developing a latent image written in the photoreceptor by the latent image forming member 56 for forming a developer image, and a cleaning device 60 which cleans the toner remaining on the photoreceptor 52 after the transfer of an image are mounted in the image forming structural body 48.

The image forming structural body 48 is constituted by joining a photoreceptor unit 62 and a developing unit 64 which are separable from each other. With respect to the photoreceptor unit 62, the photoreceptor 52, a charging device 54, a latent image forming member 56 and the cleaning device 60 are housed in a first housing 66. With respect to a developing unit 64, a developing device 58 is housed in a second housing 68. Further, the first housing 66 and the second housing 68 are joined to each other to form the separable image forming structural body 48.

In this embodiment, although the photoreceptor 52, the charging device 54, the latent image forming member 56, the developing device 58, and the cleaning device 60 are integrally formed as the image forming structural body 48, it is sufficient that the photoreceptor 52 and the latent image forming member 56 are integrally formed as a structural body. It is not always necessary to integrally form the charging device 54, the developing device 58 and the cleaning device 60 into the image forming structural body 48. For example, the charging device 54, the developing device 58 and the cleaning device 60 may be mounted on the image forming apparatus body 12 side.

As a latent image forming member 56, an LED (light emitting diode) is used, for example.

A photoreceptor 52 has an approximately cylindrical shape and bearings 53, 53 which constitute supporting members are respectively mounted on both sides of the photoreceptor 52. Bearings 53, 53 have a diameter larger than a diameter of the photoreceptor 52 and support the photoreceptor 52 so that the photoreceptor 52 is rotatable about a rotational center 52*a* as the center of rotation. The bearings 53, 53 are mounted on the image forming structural body 48 in a state that portions of the bearings 53, 53 project to the outside from the image forming structural body 48.

On one of the bearings 53, 53, the photoreceptor gear 110 is mounted at a position opposite to the photoreceptor 52 for transmitting driving to the photoreceptor 52 such that the photoreceptor gear 110 is arranged outside the image forming structural body 48. The photoreceptor gear 110 is rotated together with the photoreceptor 52 upon reception of transmission of the driving from a drive gear 116 which is mounted on a side plate 112 of the image forming apparatus body 12 using a bearing 114.

The developing device 58 adopts two-component system, for example, wherein a developer constituted of toner and carrier is used. For example, the developing device 58 includes two augers 70, 72 arranged parallel to each other in the horizontal direction, and a developing roller 74 which is arranged at an upper and oblique position from the auger 72 on an exit side and agitates a developer using the augers 70, 72. The developing device 58 supplies the agitated developer to the developing roller 74. A magnetic brush is formed on the developing roller 74 due to the carrier and the developing roller 74 transfer the toner adhered to the carrier by the magnetic brush thus developing a latent image formed on the photoreceptor 52 using the toner. In the developing device 58 of this embodiment which adopts the two-component system, the developing roller 74 is arranged above the augers 70, 72 so that the accumulation of the developer can be prevented and the developer can be uniformly agitated whereby the developer can maintain the developing property.

The cleaning device 60 is, for example, constituted of a toner scraping portion 76 formed of a blade, and a collecting portion 78 for collecting the toner scraped in the toner scraping portion 76.

The image forming structural bodies 48 are used as a pushing section when the image forming structural bodies 48 are mounted in the image forming apparatus body 12. The image forming structural bodies 48 are respectively biased using springs 100 formed of a resilient body, for example, in the direction of a transfer structural body housing 86 described later, and are pushed to the transfer structural body housing 86. One end side of each spring 100 is fixed to the image forming apparatus body 12, while the other end side of the spring 100 is brought into contact with the image forming structural body 48 directly or indirectly by way of other members.

The transfer structural body 15 includes the transfer structural body housing 86, on which the support rollers 42, the transfer members 50 and the tension roller 46 are rotatably mounted. The intermediate transfer belt 14 is supported on the support rollers 42. Further, in the transfer structural body 15, an intermediate transfer belt cleaning device 44 is detachably mounted.

The transfer structural body housing 86 includes a sheet-front-surface-side side plate 88 and a sheet-depth-side side plate 90 in FIG. 3, wherein the side plate 88 and the side plate 90 are connected with each other by a ceiling plate 92. The side plate 88 and the side plate 90 are used as first restricting members for restricting the movement of the image forming structural bodies 48 in at least two directions. A downwardly opening portion is formed in the transfer structural body housing 86, and the transfer structural body housing 86 is configured to expose a portion of the intermediate transfer belt 14 from the opening portion. In the side plate 88, four notched portions 94 for arranging the image forming structural body 48 are formed. Also in the side plate 90, four notched portions are formed in the same manner as the side plate 88 (not shown in the drawing).

Four downwardly projecting portions 118 used as second restricting members are formed on portions of the notched portions 94 formed in the side plate 88. The number of the downwardly projecting portions 118 is equal to the number of the image forming structural bodies 48 used for image forming. Also on the notched portions formed in the side plate 90, four projecting portions 118 are formed in the same manner as the side plate 88. The projecting portions 118 are arranged to be positioned downstream of the photoreceptor 52 in the rotational direction of the photoreceptor 52 with respect to the rotational center 52*a* of the photoreceptor 52. That is, the projecting portions 118 are provided at a position where the projecting portions 118 can restrict the movement of the image forming structural body 48 toward the downstream side in the rotational direction of the photoreceptor 52.

For positioning the transfer structural body 15 and the image forming structural body 48 constituted in such a manner in the image forming apparatus body 12, the transfer structural body 15 is positioned with respect to the image forming apparatus body 12 and, thereafter, the plurality of image forming structural bodies 48 are positioned with respect to the positioned transfer structural body 15. The positioning of the transfer structural body 15 with respect to the image forming apparatus body 12 is, for example, performed with respect to a frame (not shown in the drawing) of the image forming apparatus body 12.

The positioning of the image forming structural body 48 with respect to the transfer structural body 15 is performed such that the previously-mentioned bearings 53, 53 are respectively pushed to the side plates 88, 90. That is, portions of the bearings 53, 53 projecting from the image forming structural bodies 48 are respectively brought into contact with the notched portions 94 formed in the side plates 88, 90 and, in this state, the image forming structural bodies 48 are pushed to the side plates 88, 90 using the springs 100, 100 which constitute the pushing section.

As described above, in this embodiment, the plurality of image forming structural bodies 48, 48, 48 are pushed to the transfer structural body housing 86 which constitutes one member and are positioned with respect to the transfer structural body housing 86 which constitutes one member.

When the image forming structural bodies 48 are pushed to the transfer structural body housing 86 using the springs 100, 100, the bearings 53, 53 are respectively brought into contact with two portions respectively formed on the side plates 88, 90 such as a peripheral portion 104 extending in the approximately vertical direction and a peripheral portion 106 extending in the approximately horizontal direction and hence, the image forming structural body 48 is positioned at the rotational center 52*a* of the photoreceptor 52 by reference to the side plates 88, 90.

When the image forming structural body 48 is positioned in the image forming apparatus body 12 by way of the transfer structural body housing 86, the photoreceptor gear 110 and the drive gear 116 are meshed with each other so that rotational driving can be transmitted to the photoreceptor 52 from the image forming apparatus body 12 side by way of the drive gear 116 and the photoreceptor gear 110.

Further, when the image forming structural bodies 48 are positioned in the image forming apparatus body 12, not only the bearing 53 is brought into contact with the peripheral portion 104 and the peripheral portion 106, but also an end portion 48*a* of the image forming structural body 48 on a side opposite to a side where the bearing 53 is positioned is brought into contact with the projecting portion 118. Accordingly, the image forming structural body 48 is brought into contact with the side plate 88 at three points or three portions consisting of the peripheral portion 104, the peripheral portion 106 and the projecting portion 118 in a sheet-front-surface-side shown in FIG. 3. Also in the sheet-depth side shown in FIG. 3, in the same manner as in a sheet-front-surface side, the image forming structural body 48 is brought into contact with the side plate 90 at three points.

As described above, the image forming apparatus 10 performs image forming in a state that the transfer structural body 15 and the respective image forming structural bodies 48 are mounted in the image forming apparatus body 12. When the image forming apparatus 10 performs image forming, the respective photoreceptors 52 are rotated in the counterclockwise direction indicated by an arrow as shown in FIG. 2. Due to reasons including such rotation of the photoreceptor 52 in the counterclockwise direction, there may be a case in which a force which intends to rotate the image forming structural body 48 in the counterclockwise direction about the rotational center 52*a* of the photoreceptor 52 as the center of rotation is applied to the image forming structural body 48. In such a case, the projecting portion 118 which is brought into contact with the end portion 48*a* restricts the movement of the end portion 48*a* thus restricting the rotation of the image forming structural body 48.

In this embodiment, four image forming structural bodies 48 are pushed to the transfer structural body housing 86 so as to position the four image forming structural bodies 48 with respect to the transfer structural body 15. However, the respective image forming structural bodies 48 may be positioned with respect to the image forming apparatus body 12 side such as a frame of the image forming apparatus body 12, for example.

In this embodiment, as mentioned previously, the projecting portion 118 restricts the movement of the image forming structural body 48 in the rotational direction about the rotational center 52*a* of the photoreceptor 52 as the center of rotation. Further, by restricting the movement of the image forming structural body 48 in the rotational direction, the projecting portion 118 restricts the change of the distance L along the surface of the photoreceptor 52 between a writing position "a" at which the latent image forming member 56 performs writing of a latent image on the photoreceptor 52 and a transfer position "b" at which the transfer member 50 transfers the toner image carried by the photoreceptor 52 to the sheet.

The distance L is decreased when the image forming structural body 48 is rotated right-handedly (in the counterclockwise direction) in the drawing and is increased when the image forming structural body 48 is rotated left-handedly (in the clockwise direction) in the drawing. When the distance L is decreased, a developer image reaches to the transfer position "b" earlier than predetermined timing using the exposure time as the reference. On the other hand, when the distance L is increased, the developer image reaches the transfer position later than predetermined timing using the exposure time as the reference. Further, both when the distance L is increased and when the distance L is decreased, a toner image is transferred to the intermediate transfer belt 14 at timing different from the predetermined timing thus causing the occurrence of an image defect such as color shifting or the like on an image finally formed on a sheet.

As described above, in the image forming apparatus 10, the side plates 88, 90, the projecting portion 118, the bearings 53, 53 and the springs 100, 100 are used as a restricting unit, wherein these members restrict the movement of the image forming structural body 48 in two directions, that is, the approximately vertical direction and the approximately horizontal direction and, at the same time, these members restrict the movement of the photoreceptor 52 in the rotational direction in the image forming structural body 48.

In the image forming apparatus 10 having such a constitution, to pull out the image forming structural body 48 of the image forming apparatus body 12, the pushing pressure of the bearings 53, 53 applied to the side plates 88, 90 using the spring 100, 100 is removed before pulling out the image forming structural body 48 of the image forming apparatus body 12. Further, the projecting portion 118 and the image forming structural body 48 are made spaced-apart from each other, thus removing the restriction imposed on the rotation of the image forming structural body 48 applied by the projection portion 118 and, at the same time, removing the restriction imposed on the change of the distance L (see FIG. 2). Such removing of pushing pressures is performed by moving the image forming structural body 48 downwardly, for example, using a moving section formed of the link structure or the like.

On the other hand, in mounting the image forming structural body 48 in the image forming apparatus body 12, the image forming structural body 48 is inserted into the image forming apparatus body 12 and, thereafter, the projecting portion 118 and the end portion 48*a* of the image forming structural body 48 are brought into contact with each other, and a state that the image forming structural body 48 is pushed to the transfer structural body housing 86 is held using springs 100, 100. In this state, the projecting portion 118 restricts the rotation of the image forming structural body and, at the same time, restricts the change of the distance L (see FIG. 2). For allowing the image forming structural body 48 to move in the image forming apparatus body 12 such that the image forming structural body 48 is brought into contact with the projecting portion 118, the image forming structural body 48 is moved upwardly, for example, using a moving section constituted of a link mechanism or the like from a position where the image forming structural body 48 is inserted into the image forming apparatus body 12, for example.

Figure 5:
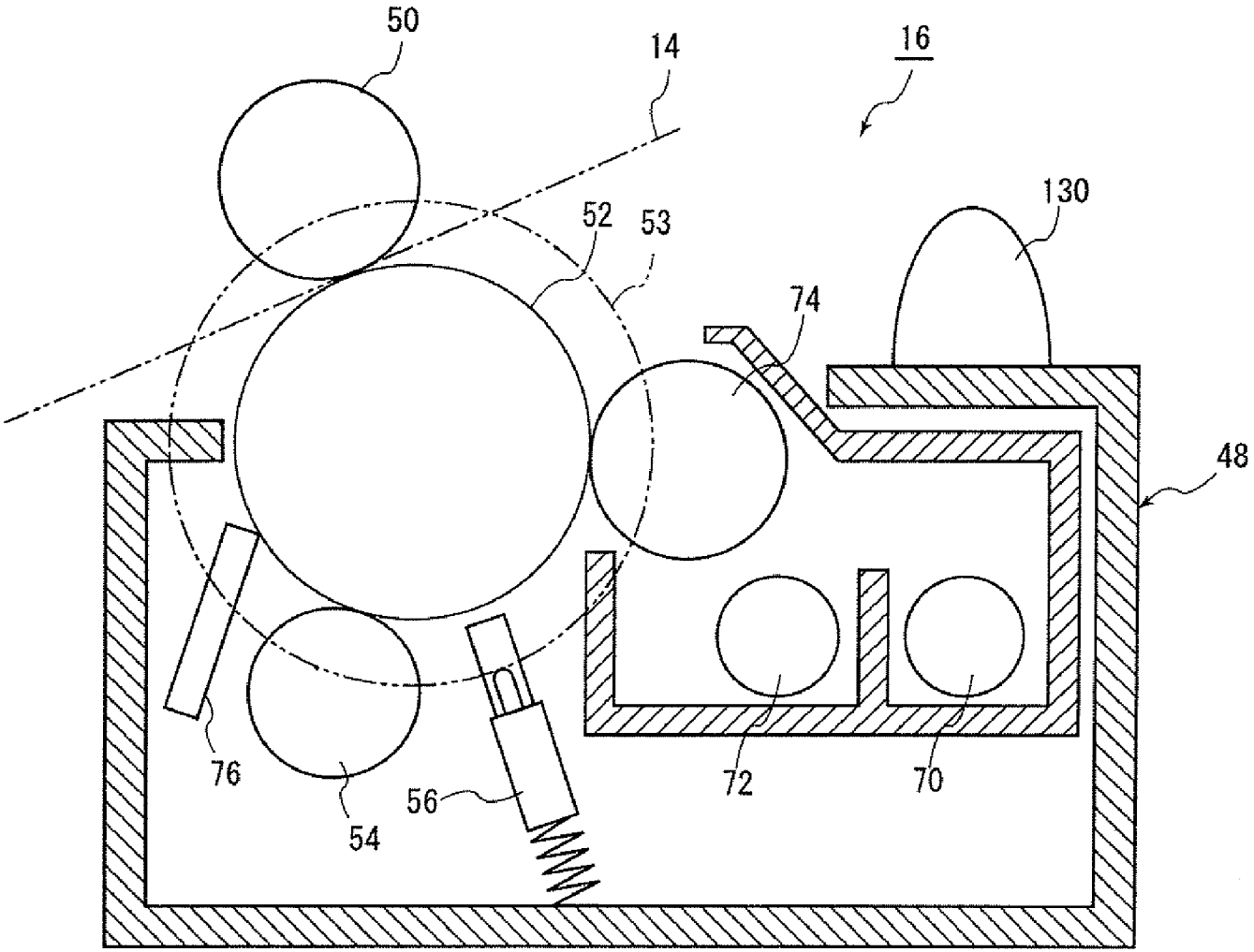
FIG. 5 A front view showing the constitution of an image forming structural body of a second embodiment of the present invention.
Figure 6:
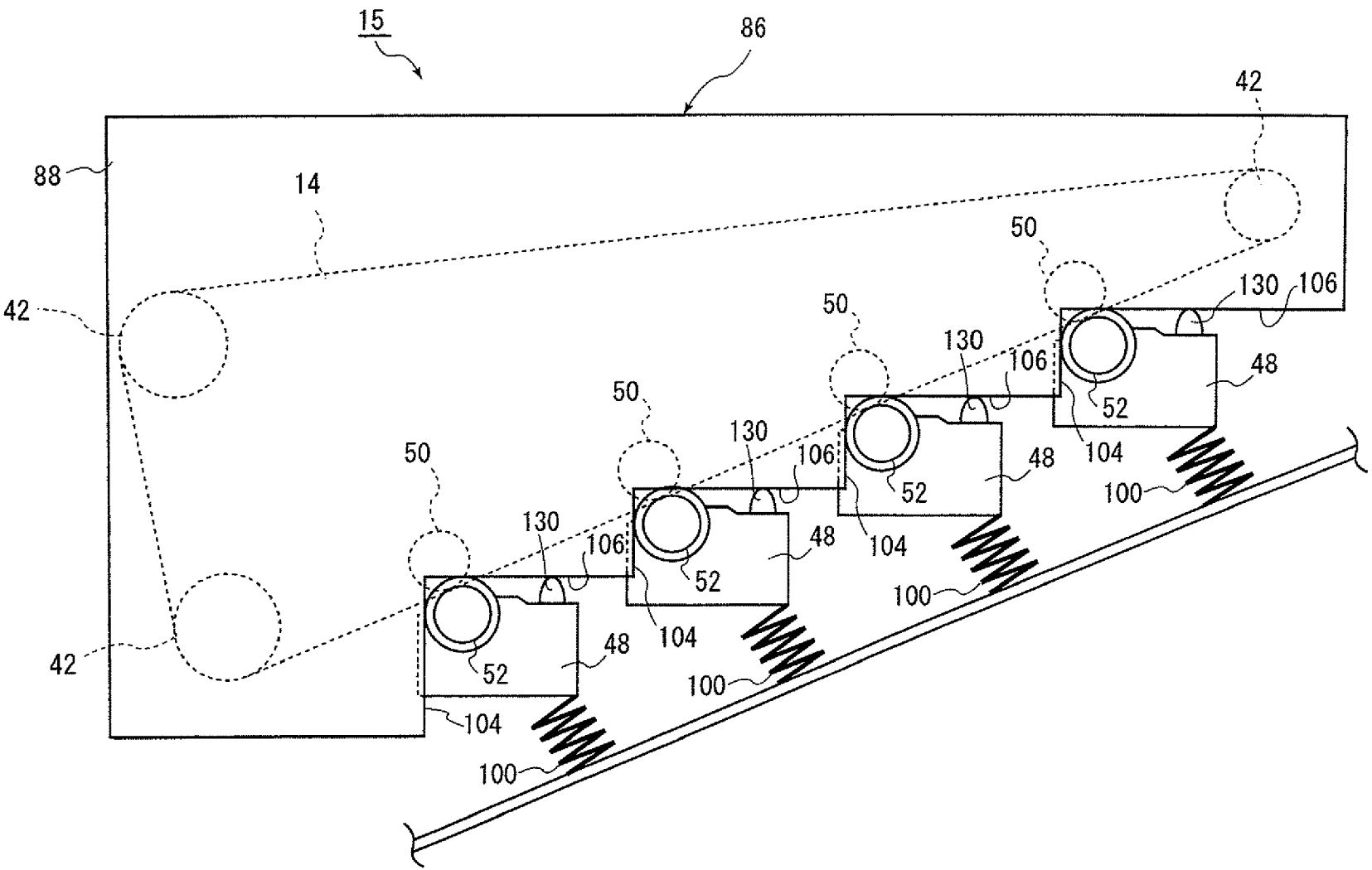
FIG. 6 A front view showing the constitution of the transfer structural body used in the second embodiment of the present invention and a state in which the image forming structural body is positioned in the transfer structural body.

FIG. 5 and FIG. 6 show the image forming sections 16 and the transfer structural body 15 according to the second embodiment of the prevent invention. In the first embodiment described above, the projecting portions 118, 118, 118, 118 are formed on the side plate 88 of the transfer structural body housing 86, and four projecting portions are formed on the side plate 90 in the same manner. Here, these projecting portions are used as the second restricting member for restricting the movement of the image forming structural body 48 in the rotational direction. Contrary to such a constitution, in the second embodiment, a projecting portion 130 is formed on a side opposite to a side where the photoreceptor 52 of the image forming structural body 48 is positioned, and the projecting portion 130 is used as the second restricting member.

Two projecting portions 130 are mounted on each image forming structural body 48 such that, for example, one projecting portion 130 is mounted on a sheet-front-surface side in the axial direction of the photoreceptor 52 in FIG. 5, and the other projecting portion 130 is mounted on a sheet-depth side in such an axial direction. In a state that the image forming structural body 48 is positioned with respect to the transfer structural body housing 86, the projecting portion 130 on the sheet-front-surface side is brought into contact with a side plate 88 on the sheet-front-surface side and the projecting portion 130 on the sheet-depth side is brought into contact with the side plate 90. In this state, the projecting portion 130 on the sheet-front-surface side and the projecting portion 130 on the sheet-depth side are pushed to the side plate 88 and the side plate 90 by springs 100, 100.

Figure 7:
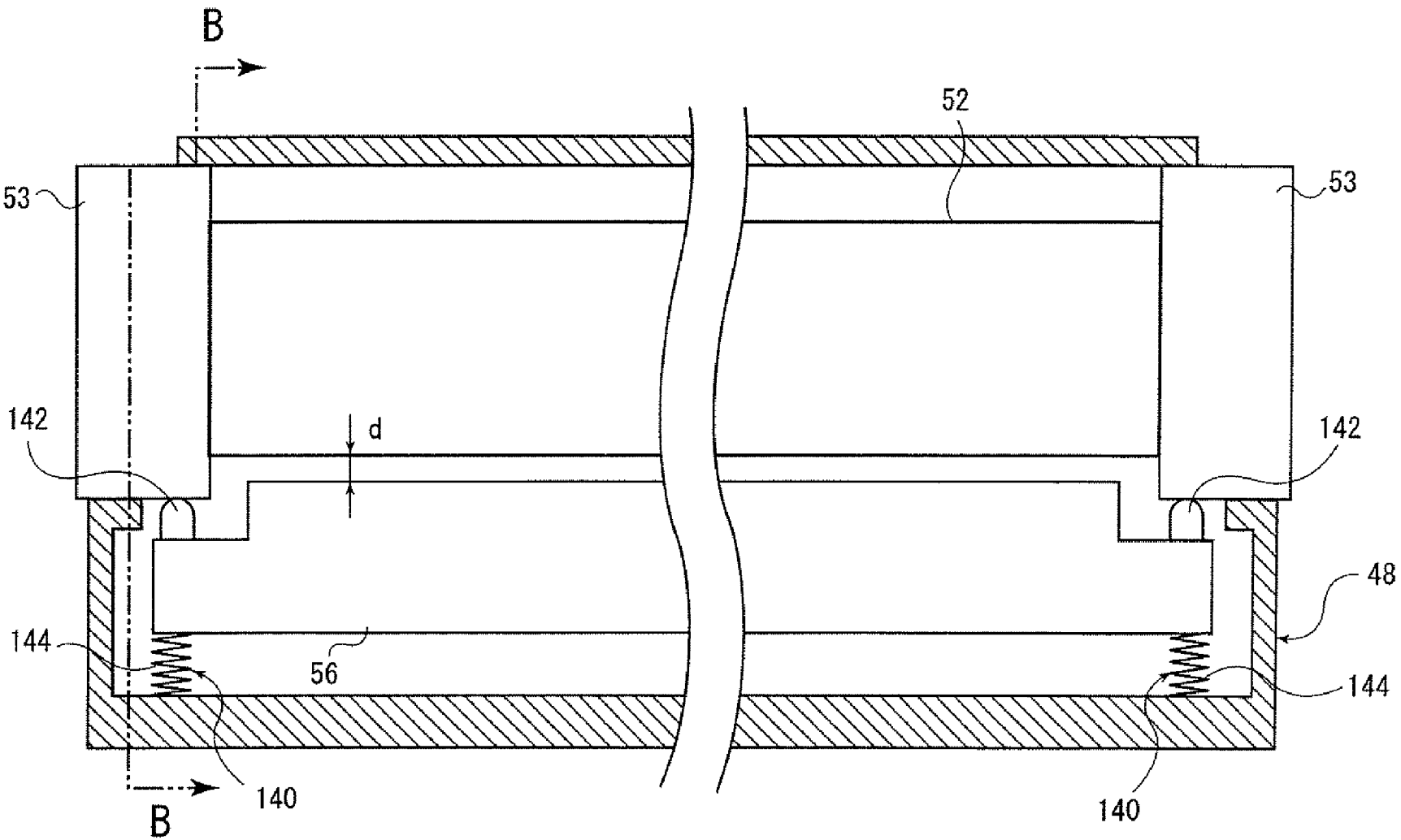
FIG. 7 A cross-sectional view showing a positioning mechanism which is used in the second embodiment of the present invention and positions a writing member with respect to an image carrier.
Figure 8:
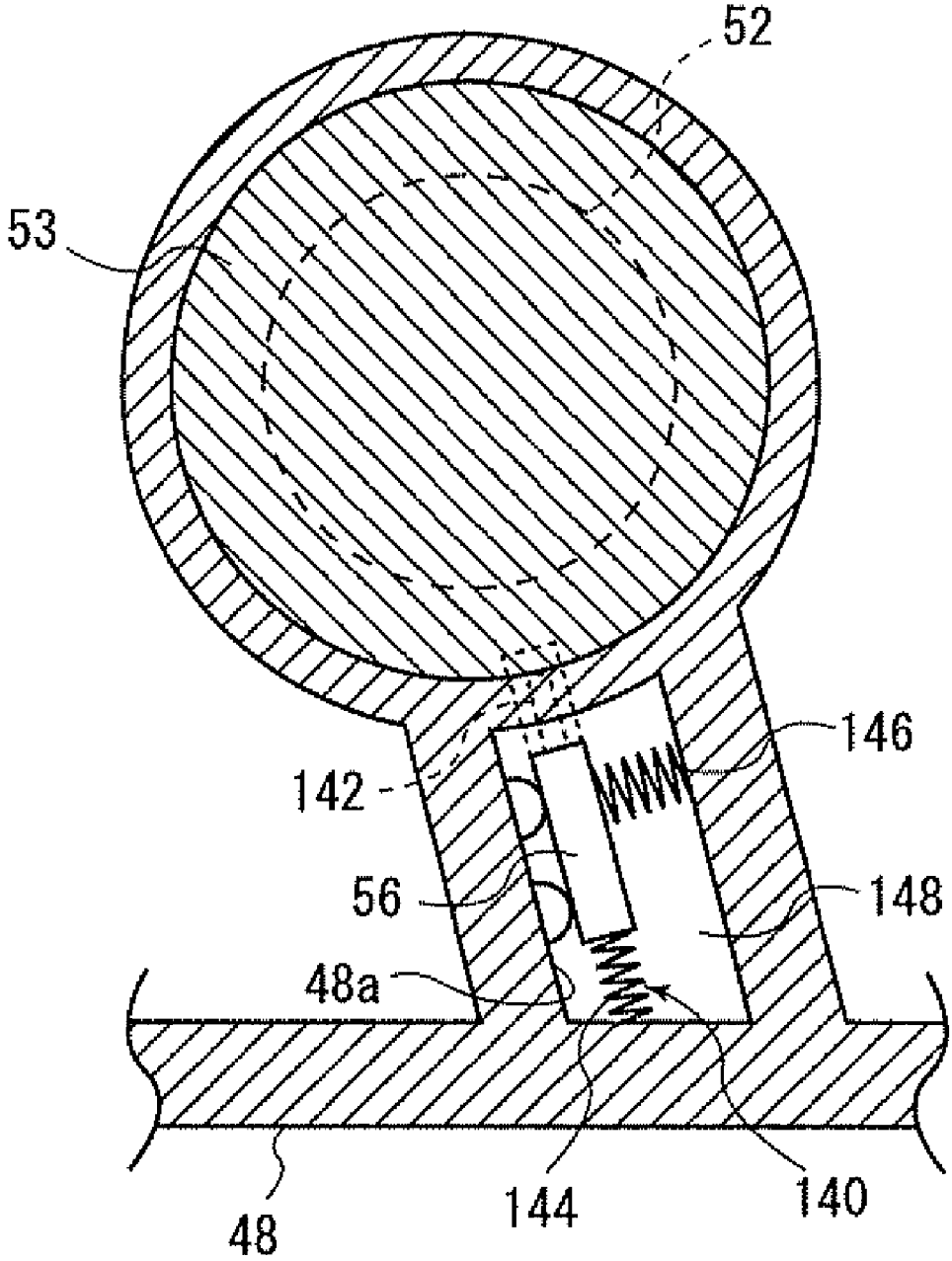
FIG. 8 A cross-sectional view showing the positioning mechanism which is used in the second embodiment of the present invention and positions the writing member with respect to the image carrier and is a cross-sectional view of the positioning mechanism taken along a line B-B in FIG. 7.

FIG. 7 and FIG. 8 show positioning mechanisms 140, 140 which position a latent image forming member 5G with respect to a photoreceptor 52 in the second embodiment of the present invention. One positioning mechanism 140 is formed on both end portion sides of the latent image forming member 56 respectively, and each of the positioning mechanisms 140 includes a projecting portion 142 which is formed on a latent image forming member 56 and projects in the direction toward a bearing 53. The projecting portion 142 is used as a restricting member for restricting a distance "d" defined between the latent image forming member 56 and the photoreceptor 52. When the latent image forming member 56 is assembled in the image forming structural body 48, an end portion of the positioning mechanism 140 is brought into contact with the bearing 53.

The positioning mechanism 140 is respectively used as a first biasing member and includes a spring 144 made of an elastic material. One end portion of the spring 144 is fixed to the latent image forming member 56 and the other is fixed to an inner wall of the image forming structural body 48, and the spring 144 biases the latent image forming member 56 in the direction toward the photoreceptor 52. By biasing the latent image forming member 56, the projecting portions 142, 142 are pushed to the bearings 53, 53.

The positioning mechanisms 140 are respectively used as second biasing members and each of the positioning mechanisms 140 includes a spring 146 made of an elastic material. One end of the spring 146 is fixed to a surface of the latent image forming member 56 which is substantially perpendicular to the surface of the latent image forming member 56 to which the spring 144 is fixed, and the other end of the spring 146 is fixed to the inside of the image forming structural body 48. The latent image forming member 56 is pushed to an inclined inner wall 48*b* of the image forming structural body 48 by the spring 146 and is positioned with respect to the image forming structural body 48.

In a state that the latent image forming member 56 is positioned by the positioning mechanisms 140, 140, the latent image forming member 56 have portions which are not brought into contact with the image forming structural body 48 and other members on an outer side surface thereof, and a space 148 which is not occupied by other members is formed around the image forming member 56. The space 148 can store air for cooling the latent image forming member 56 which is heated to a high temperature due to writing, for example, or can be used as a flow passage for allowing the flow of a cooling medium such as air, for example, for cooling the latent image forming member 56. Here, parts identical to the parts used in the first embodiment are given the same numbers in FIG. 5 to FIG. 8 and their explanation is omitted.

Figure 9:
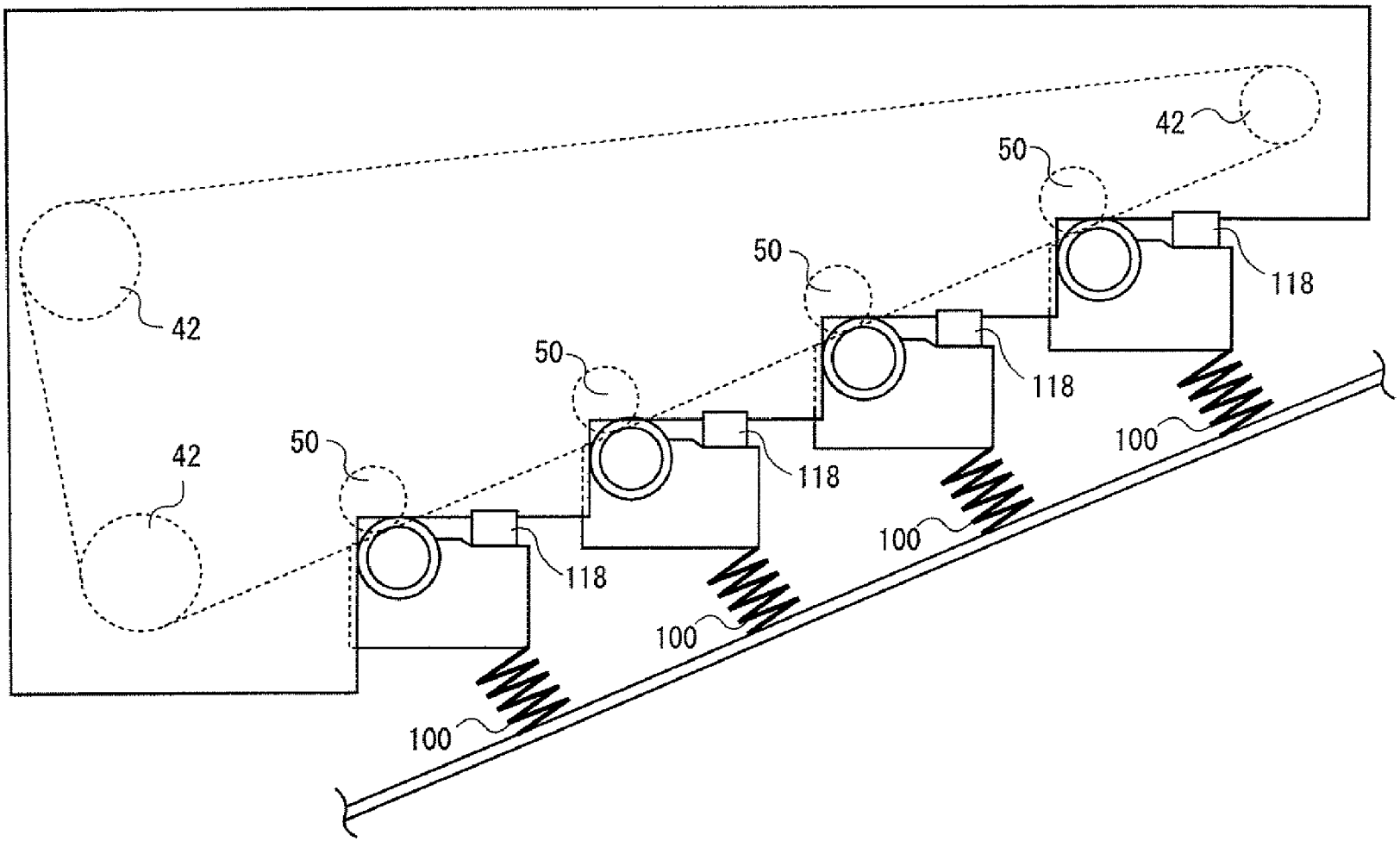
FIG. 9 A front view showing the constitution of a transfer structural body used in a third embodiment of the present invention and a state in which an image forming structural body is mounted on the transfer structural body.

FIG. 9 shows a transfer structural body 15 used in the third embodiment of the present invention. In the first embodiment described above, the projecting portions 118, 118, 118, 118 are integrally formed on the side plate 88 of the transfer structural body housing 86 and four projecting portions are integrally formed in the same manner on the side plate 90. Contrary to such a constitution, in the third embodiment, the projecting portions 118 are respectively formed as parts separate from the side plate 88 and the side plate 90 and the projecting portions 118 are mounted on the side plate 88 or the side plate 90. Here, parts identical to the parts used in the first embodiment are given the same numbers in FIG. 9 and their explanation is omitted.

INDUSTRIAL APPLICABILITY

As has been described heretofore, the present invention is applicable to image forming apparatuses such as a photocopying machine, a facsimile device and a printer, an image forming structural body used for these image forming apparatuses, a mounting method of the image forming structural body, and a method of pulling out the image forming structural body.

The invention claimed is:

1. An image forming apparatus comprising:

a conveyer that conveys a developer image or a transfer medium to which the developer image is transferred;

a supporting member that supports the conveyer;

an image carrier means that carries the developer image transferred to the conveyer or the transfer medium which the conveyer conveys;

a latent image forming unit that forms the latent image on the image carrier;

a developing unit that develops the latent image formed on the image carrier and forms a developer image;

a transfer unit that transfers the developer image formed on the image carrier; and a restricting unit that restricts the movement of the image carrier and the latent image forming unit in at least two directions and a rotational direction of the image carrier to push the image carrier and the latent image forming unit to the supporting member.

2. The image forming apparatus according to claim 1, wherein the image forming apparatus includes the image carrier, the latent image forming unit, the developing unit, and the transfer unit in plurality respectively, and the restricting unit restricts the respective movement of the image carrier and the latent image forming unit.

3. The image forming apparatus according to claim 1, further comprising:

a developing device that develops the latent image formed on the image carrier using a developer;

a transfer device that transfers the developer image formed on the image carrier; the restricting unit includes a first restricting member that restricts the movement of the image carrier and the latent image forming unit in at least two directions, and a second restricting member that restricts the movement of the image carrier and the latent image forming unit in a rotational direction of the image carrier.

4. The image forming apparatus according to claim 3, wherein the second restricting member is provided at a position where the second restricting member restricts the movement of the latent image forming unit toward a downstream side in the rotational direction of the image carrier.

5. The image forming apparatus according to claim 3, wherein the second restricting member is provided to the first restricting member.

6. The image forming apparatus according to claim 3, further comprising a conveying structural body that houses the conveyer, wherein the second restricting member is provided to the conveying structural body.

7. The image forming apparatus according to claim 1, further comprising an image forming structural body that houses at least the image carrier and the latent image forming unit.

8. The image forming apparatus according to claim 7, further comprising a pushing member that pushes the image forming structural body to the second restricting member.

9. The image forming apparatus according to claim 7, further comprising a pushing member that pushes the image forming structural body to the first restricting member.

10. The image forming apparatus according to claim 7, wherein the second restricting member is provided to the image forming structural body.

11. The image forming apparatus according to claim 1, wherein the restricting unit includes a projecting portion formed on the image forming apparatus, the projecting portion directly contacting an upper surface of the image carrier means.

12. An image forming structural body comprising:

an image carrier that carries a developer image; and a latent image forming unit that forms a latent image on the image carrier, the latent image further being developed to form the developer image, wherein the image forming structural body is mounted on an image forming apparatus body having a supporting member that supports a conveyer such that the movement of the image forming structural body is restricted in at least two directions and in a rotational direction of the image carrier to push the image carrier and the latent image forming unit to the support member.

13. The image forming structural body according to claim 12, wherein the image forming structural body is mounted on an image forming apparatus body such that the movement of the image forming structural body in at least two directions is restricted by a first restricting member, and the movement of the image forming structural body in a rotational direction of the image carrier is restricted by a second restricting member.

14. The image forming structural body according to claim 12, wherein the image forming apparatus body includes a projecting portion formed on a lower surface of the image forming apparatus body, the projecting portion directly contacting an upper surface of the image forming structural body.

15. The image forming structural body according to claim 12, wherein the movement of the image forming structural body is restricted by a first restricting member that restricts the movement of the image forming structural body in the at least two directions, and a second restricting member that restricts the movement of the image forming structural body in the rotational direction of the image carrier.

16. A method of mounting an image forming structural body including an image carrier that carries a developer image and a latent image forming unit that forms a latent image on the image carrier, the latent image further being developed to form the developer image, the method comprising:

inserting the image forming structural body into an image forming apparatus body having a supporting member that supports a conveyer; and restricting the movement of the image forming structural body in at least two directions and a rotational direction of the image carrier to push the image carrier and the latent image forming unit to the supporting member.

17. The method of mounting an image forming structural body according to claim 16, wherein the movement of the image forming structural body is restricted by a projecting portion formed on a lower surface of the image forming apparatus body, the projecting portion directly contacting an upper surface of the image forming structural body.

18. The method of mounting an image forming structural body according to claim 16, wherein the movement of the image forming structural body is restricted by a first restricting member that restricts the movement of the image forming structural body in the at least two directions, and a second restricting member that restricts the movement of the image forming structural body in the rotational direction of the image carrier.

19. A method of pulling out an image forming structural body including an image carrier that carries a developer image and a latent image forming unit that forms a latent image on the image carrier, the latent image further being developed to form the developer image, the method comprising:

removing restriction imposed on the movement of the image forming structural body in at least two directions and a rotational direction of the image carrier; and;

pulling the image forming structural body out of an image forming apparatus body having a supporting member that supports a conveyer, wherein the movement of the image forming structural body is restricted in the at least two directions and the rotational direction of the image carrier to push the image carrier and the latent image forming unit to the supporting member.

20. The method of pulling out an image forming structural body according to claim 19, wherein the movement of the image forming structural body is restricted by a projecting portion formed on a lower surface of the image forming apparatus body, the projecting portion directly contacting an upper surface of the image forming structural body.

21. The method of pulling out an image forming structural body according to claim 19, wherein the movement of the image forming structural body is restricted by a first restricting member that restricts the movement of the image forming structural body in the at least two directions, and a second restricting member that restricts the movement of the image forming structural body in the rotational direction of the image carrier.

* * * * *